US006463337B1

(12) United States Patent
Walker

(10) Patent No.: US 6,463,337 B1
(45) Date of Patent: Oct. 8, 2002

(54) RAILROAD VITAL SIGNAL OUTPUT MODULE WITH CRYPTOGRAPHIC SAFE DRIVE

(75) Inventor: Jim E. Walker, San Bernardino, CA (US)

(73) Assignee: Safetran Systems Corporation, Minneapolis, MN (US)

( * ) Notice: Subject to any disclaimer, the term of this patent is extended or adjusted under 35 U.S.C. 154(b) by 0 days.

(21) Appl. No.: 09/467,796

(22) Filed: Dec. 20, 1999

(51) Int. Cl.[7] ..... B61L 7/00

(52) U.S. Cl. ..... 700/4; 246/167 R; 246/167 D; 340/907; 714/739; 714/744

(58) Field of Search ..... 246/167 R, 167 D; 340/907–932; 700/4; 714/739, 744

(56) References Cited

U.S. PATENT DOCUMENTS

| | | | | |
|---|---|---|---|---|
| 3,543,236 A | | 11/1970 | Sibley | |
| 3,700,886 A | | 10/1972 | Birkin | |
| 3,800,139 A | | 3/1974 | Clark | |
| 3,885,228 A | | 5/1975 | Katz et al. | |
| 4,068,211 A | | 1/1978 | Van Tol | |
| 4,133,504 A | | 1/1979 | Dobler et al. | |
| 4,187,465 A | | 2/1980 | Garbrecht et al. | |
| 4,234,870 A | | 11/1980 | Sibley | |
| 4,247,790 A | | 1/1981 | Sahasrabudhe et al. | |
| 4,270,715 A | | 6/1981 | Norton et al. | |
| 4,307,463 A | | 12/1981 | Sibley | |
| 4,320,881 A | | 3/1982 | Campbell | |
| 4,365,333 A | | 12/1982 | Mulvey | |
| 4,456,997 A | | 6/1984 | Spitza | |
| 4,494,717 A | | 1/1985 | Corrie et al. | |
| 4,611,291 A | | 9/1986 | Hoelscher | |
| 4,619,425 A | | 10/1986 | Nagel | |
| 4,652,057 A | * | 3/1987 | Engle et al. | 303/3 |
| 4,656,586 A | | 4/1987 | Ochiai et al. | |
| 4,763,267 A | | 8/1988 | Knight et al. | |
| 4,855,737 A | | 8/1989 | Poole | |
| 4,868,538 A | | 9/1989 | Ballinger et al. | |
| 4,897,640 A | | 1/1990 | Rapoen | |
| 5,094,413 A | | 3/1992 | Ripamonti | |
| 5,369,591 A | * | 11/1994 | Broxmeyer | 364/461 |
| 5,437,422 A | * | 8/1995 | Newman | 246/5 |
| 5,751,569 A | * | 5/1998 | Metel et al. | 364/132 |

* cited by examiner

*Primary Examiner*—Thomas Black
*Assistant Examiner*—Luke T. Huynh
(74) *Attorney, Agent, or Firm*—Cook, Alex, McFarron, Manzo, Cummings & Mehler, Ltd.

(57) ABSTRACT

A railroad vital signal output module provides a predetermined output signal in response to a certain module input only under conditions that insure vitality of the output signal. The module includes a master microcontroller and a plurality of slave microcontrollers. The master microcontroller generates a periodic clock signal and a plurality of pseudo-random numbers in a predetermined sequence. Each slave microcontroller generates a plurality of pseudo-random numbers in the same predetermined sequence as the master microcontroller. The numbers from the master microcontroller are compared with the numbers in the slave microcontroller if the clock signal is received at a slave master controller in a predetermined window of time and if there is identity between said pseudo-random numbers, the module provides a predetermined output signal which is assured to be vital.

20 Claims, 6 Drawing Sheets

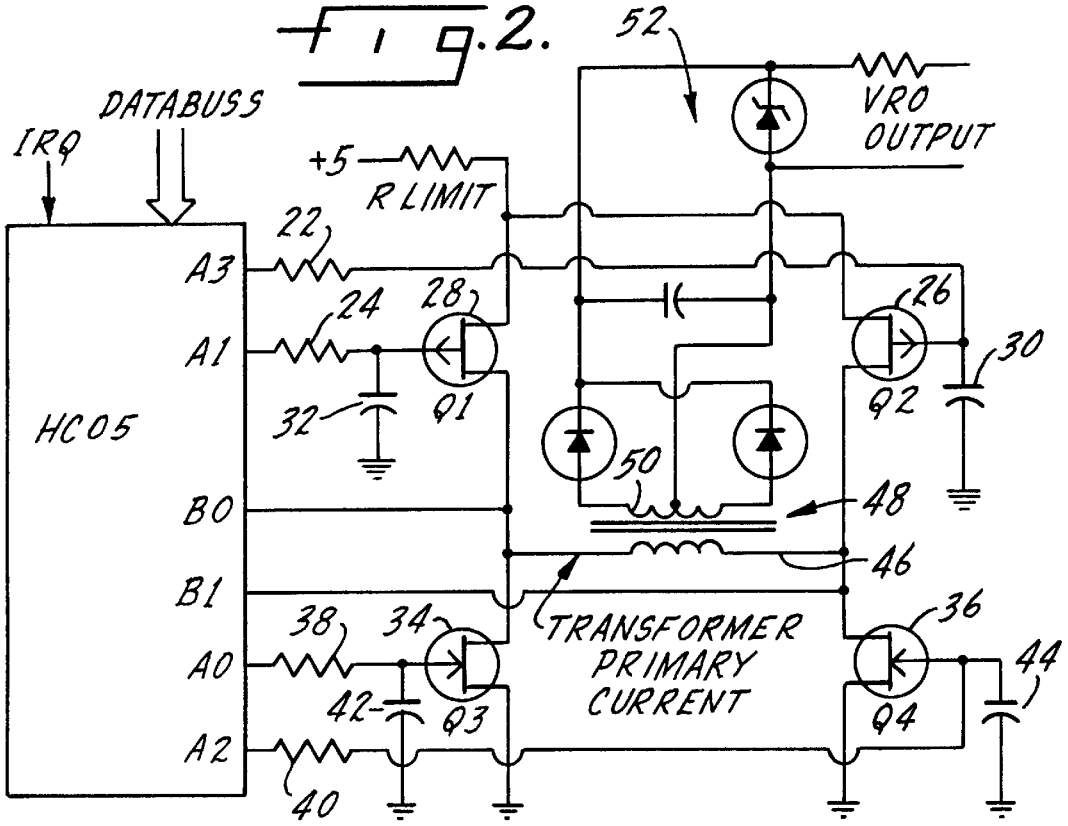
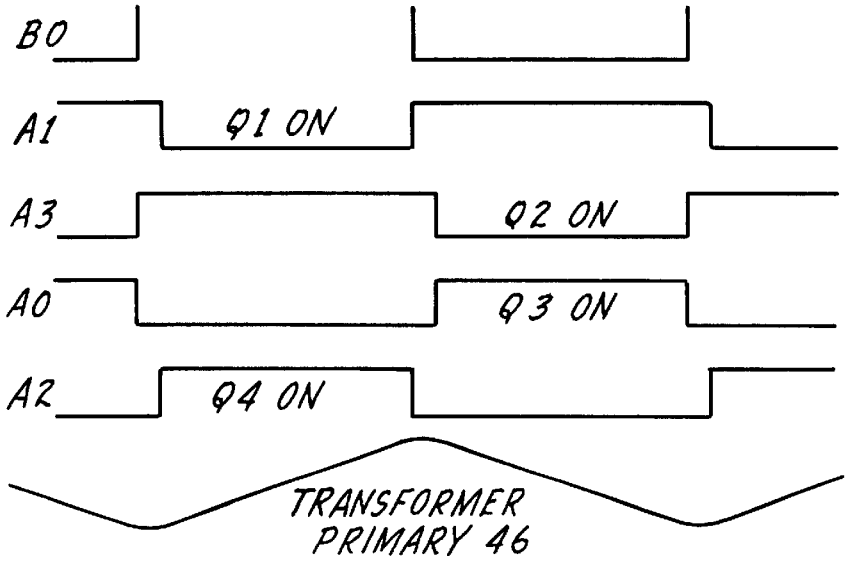
Fig. 3.

RAILROAD VITAL SIGNAL OUTPUT MODULE WITH CRYPTOGRAPHIC SAFE DRIVE

THE FIELD OF THE INVENTION

The present invention relates to a railway signal system, both for control of crossing gates and for control of train movement and more particularly relates to insuring that the output of a signal module will be fail-safe or what is described in the railroad environment as having vitality.

Installations for railway signaling, crossing gate operation and control of train movement must exhibit fail-safe or vital characteristics. By "vital" it is meant that the installation is guarded against failures and if a failure occurs, the failure produces a safe or restrictive mode of operation or control of the particular device. For example, if the signal module of the present invention controls a right-of-way signal, upon indication of a non fail-safe or non vital output signal, the signal device would turn red. Similarly, the crossing gates would come down if there was an indication of a non vital output from the module controlling operation of the crossing gate.

The present invention insures vitality by what is termed a cryptographic safe drive. Such a device insures that there cannot be an output signal of a type to permit traffic to pass or crossing gates to remain in a raised condition unless it is absolutely certain that the output signal is valid. This is accomplished in the present invention through the use of two independent comparison procedures. A master microcontroller generates both a periodic clock signal and sequential pseudo-random numbers. The master microcontroller is connected to a plurality of slave microcontrollers, each of which also generates a sequence of pseudo-random numbers. The numbers are generated in each instance by shift registers which are identical and are programmed to operate in an identical sequence.

The master microcontroller sends a clock signal at repeated intervals to a designated slave microcontroller which has been indicated to require a certain output signal. The master microcontroller also sends the currently available pseudo-random number provided by its shift register to the slave microcontroller. If the clock signal from the master is received at the slave within a predetermined time window, then, and only then, will the pseudo-random numbers from the master and the slave be compared. If the comparison indicates such numbers are identical, then the slave microcontroller will provide an output signal which statistically is known to be valid.

SUMMARY OF THE INVENTION

The present invention relates to railroad vital signal output modules and in particular to such a module which uses a comparison of pseudo-random numbers generated at two separate locations to insure vitality of the module output.

A primary purpose of the invention is an apparatus and method of using such apparatus which provides for two separate steps of comparison between master and slave microcontrollers to insure vitality of an output signal at a slave microcontroller.

Another purpose of the invention is to provide a control module and method for using such control module which includes the use of periodic clock signals and sequentially changing pseudo-random numbers, with the receipt of a clock signal within a predetermined window of time at a slave microcontroller permitting comparison of separately generated pseudo-random numbers and if such a comparison shows identical numbers, the module provides a valid output signal.

Another purpose of the invention is to provide a vital signal control module as described which includes a feedback path from the output of a slave microcontroller to the master microcontroller, which output is used to verify the functionality of the slave microcontroller.

Another purpose of the invention is to provide a railroad vital signal output module which is usable in a geographic train control such as shown in U.S. Pat. No. 5,751,569.

Another purpose of the invention is to provide a railroad vital signal output module as described which has substantially enhanced reliability and substantially reduced cost over prior modules for the same purpose.

Another purpose is a signal module as described which overcomes many of the defects of prior vital railroad signal modules.

Other purposes will appear in the ensuing specification, drawings and claims.

BRIEF DESCRIPTION OF THE DRAWINGS

The invention is illustrated diagrammatically in the following drawings wherein:

FIG. 2 is a schematic diagram of a slave microcontroller and its associated output circuit;

FIG. 3 is a waveform diagram showing the outputs from the circuit of FIG. 2;

DESCRIPTION OF THE PREFERRED EMBODIMENT

U.S. Pat. No. 5,751,569, owned by Safetran Systems Corporation, the assignee of the present application, which is herein incorporated by reference, discloses and claims a geographic train control which functions in a certain described manner as set forth in the patent. One of the outputs of the geographic control object 10 in the '569 patent is designated as a condition change output. The geographic control object may include what is described as a vital output module, the purpose of which is to provide a condition change signal which is vital in nature in that it is statistically certain that this output will only appear when it is desired that it be present. This output may be used to drive circuits, relays or other control elements which will affect the condition of a signal, a crossing gate, a switch or some other railroad control device. The function and purpose of a vital output module or simply the insurance that a signal has vitality in a railroad environment is so that there can be no condition under which that signal will appear when there has been no authorization for such an event to happen. In the railroad environment, unless a vital signal does appear, then the fail-safe aspects of the control system will turn a wayside signal to red and will have crossing gates be lowered. The condition change signal which would allow a wayside signal to be other than red, or the crossing gates to remain in an up condition, must be a vital signal and the present invention is directed to a hardware/software control system to insure such vitality.

The present invention requires two simultaneously correct conditions before there can be a vital output. These correct conditions will only permit a vital output signal for a period of 10 msec. after which the sequence of correct conditions must be repeated. The two required conditions are one directed to frequency and the other directed to a four-bit number which is characterized as a sequencing pseudo-random number. This number is developed at two separate locations and there must be correspondence between such numbers before the vital output module can provide its designated output.

Figure 1:
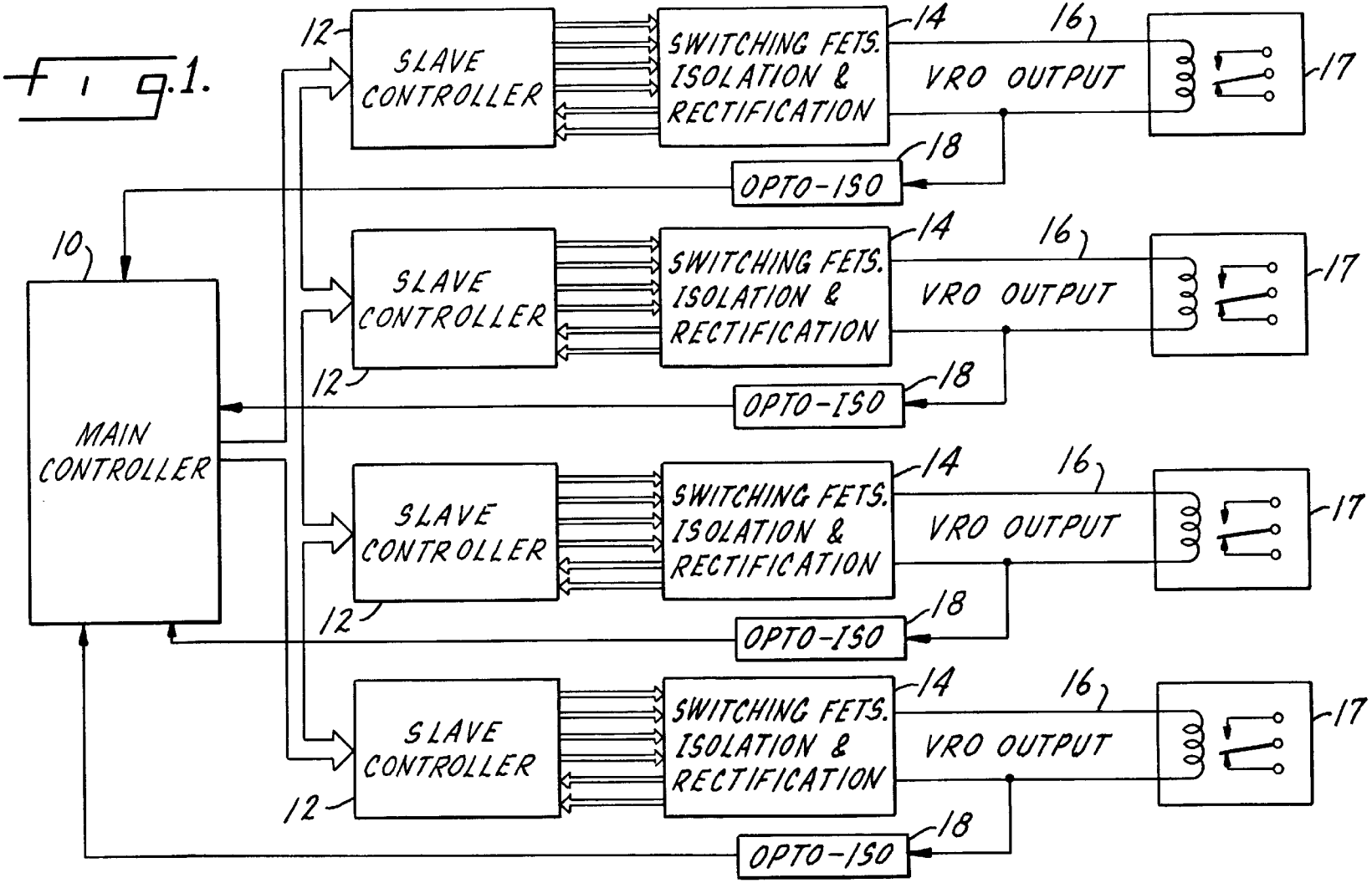
FIG. 1 is a block diagram of the vital signal control module of the present invention with connections to railroad control relays.

The VRO output module, as illustrated in FIG. 1, may include a main or master microcontroller 10 which may function in cooperation with a plurality of slave microcontrollers 12. The microcontroller 10 may utilize a Motorola HC11 microprocessor and will have its own internal system checks, as well as its own clock crystal oscillator. The master microcontroller 10 will receive input signals of a predetermined character which are to be utilized to provide designated outputs from any of the plurality of slave microcontrollers, each of which may have a VRO output and each of which outputs may be used to effect a particular condition on a train control system.

Each of the slave microcontrollers 12 will be associated with a circuit indicated at 14 in FIG. 1 and containing switching field effect transistors and other components which provide isolation, rectification, and ultimately an output signal from an output transformer. The output from each of the circuits 14, which is designated as the VRO output 16, will be fed back by an optoisolator 18 to the master microcontroller 10. The feedback path is utilized to verify the functionality of the circuit 14. The VRO output 16 will also be fed to a railroad signal relay 17 which may be used to control switch position, signal condition, or operation of a crossing gate. Each of the slave microcontrollers 12 may use a Motorola microprocessor designated as an HC05. The communication between the master microcontroller 10 and each slave microcontroller 12 will consist of a clock signal and a four-bit data signal. Each slave microcontroller 12 may have its own internal clock signal, which will be synchronized with that of the master microcontroller 10, or it may have an independent ceramic oscillator. What is important is that there be frequency generating means at each location, which are to be in correspondence, but with the timing of signals from the master to the slave being one of the safety checks forming a part of what has been designated herein as a cryptographic safe drive.

Figure 4:
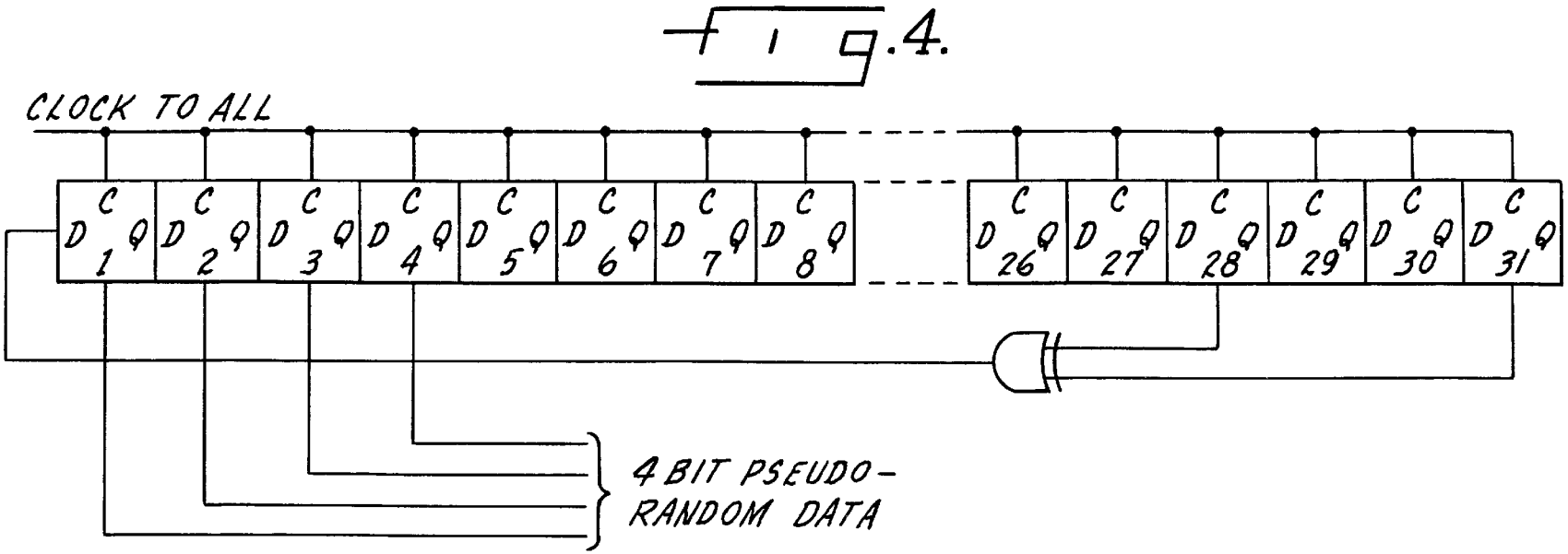
FIG. 4 is a block diagram of a shift register which may be used in both the master and slave microcontrollers.

Each of the slave microcontrollers 12 and the master microcontroller 10 may utilize a shift register such as indicated in FIG. 4 to provide a pseudo-random number. Such a shift register, and this hardware may be replicated in software, utilizes a serial in, parallel out configuration with stages 28 and 31 being connected to an exclusive OR gate. When this shift register is preloaded with a non-zero byte, and supplied with clock, it produces a pseudo-random data stream that repeats every 2,147,483,647 clock cycles. The pseudo-random number from the master will change every 10 msec. as determined by its internal clock.

To maintain a designated VRO output for 50 msec. requires five correct four-bit word comparisons in a row. The probability of this happening from random data is $2^{-20}$ or less than one in a million. To keep the VRO designated output for 100 msec. requires ten correct four-bit word comparisons in a row. The probability of this happening from random data is $2^{-40}$ or less than one in $2^{12}$. Thus, statistically, it is assured, using the described frequency and data checks, that there will only be a vital output signal when such is desired as determined by the input to the master microcontroller 10.

FIG. 2 illustrates the HC05 which is a part of the slave microcontroller and the circuit 14 which provides the VRO output. FIG. 3 illustrates the waveforms which are applied to the primary of the transformer in the circuit of FIG. 2. The A1 and A3 outputs of the HC05 20 are connected through resistors 22 and 24 to field effect transistors Q2 (26) and Q1 (28). Capacitors 30 and 32 complete the input circuits to Q1 and Q2. In like manner, the A0 and A2 outputs from the microprocessor 20 are connected to field effect transistors Q3 (34) and Q4 (36) through resistors 38 and 40, with capacitors 42 and 44 completing the RC input circuits for each of the FETS. Q1 and Q2 are P-channel FETS and Q3 and Q4 are N-channel FETS. The outputs of the described FETS are connected to the primary 46 of a transformer 48, with the secondary 50 of the transformer being connected through a bridge rectifier indicated generally at 52 to the VRO output 16.

The waveforms for the circuit of FIG. 2 are shown in FIG. 3. In essence, when Q1 and Q4 are on, and subsequently when Q2 and Q3 are on, non-overlapping square wave pulses at a frequency to be described are provided to the transformer primary 46. This waveform is shown at the bottom of FIG. 3. The output from the secondary 50 of transformer 48 will be a series of pulses of the desired frequency, which transformer secondary signal is full wave rectified and coupled to the VRO output. The output is a nominal 12 volts, although obviously this could be otherwise and is dependent upon the particular control system, and will only take place when the microprocessor 20 provides the desired outputs on the designated terminals which will only take place under the conditions to be described herein.

Figure 5:
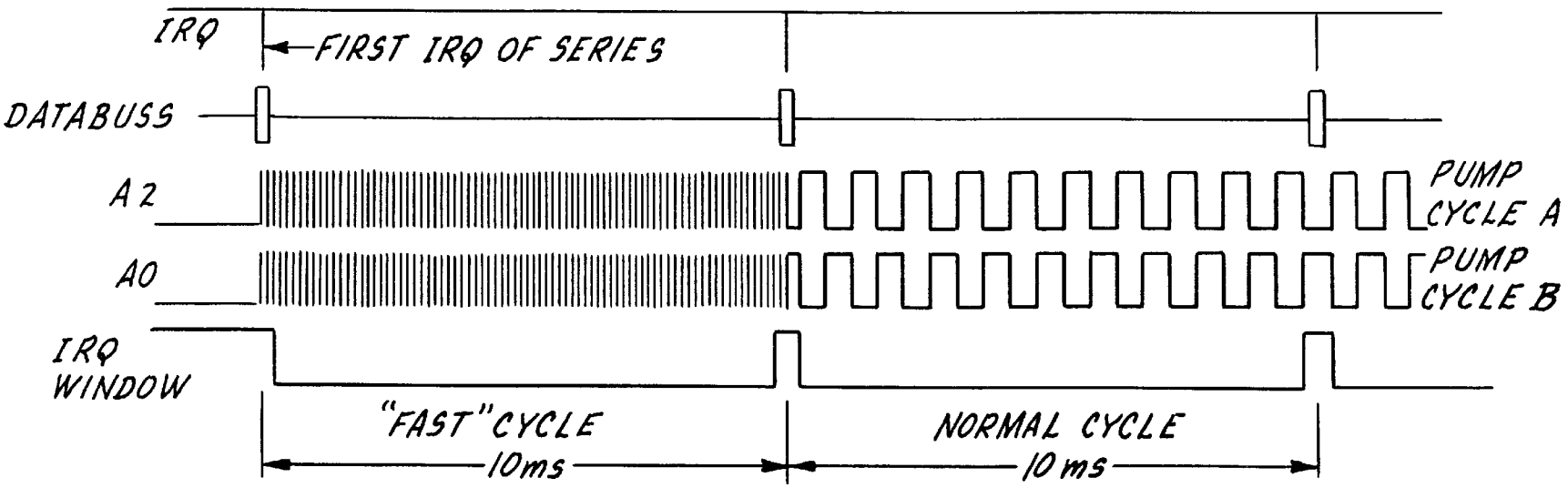
FIG. 5 is a waveform diagram showing the inputs to a slave microcontroller and the pulses generated in response thereto in the output circuit of a slave microcontroller.

FIG. 5 illustrates the basic timing for the FET drive outputs with pump cycle A occurring during the period that Q1 and Q4 are on, and pump cycle B occurring during the time that Q2 and Q3 are on. The clock signal, which is designated herein as "IRQ," will be sent every 10 msec. and the data signal from the master microcontroller 10 to the slave microcontroller 12 will be contemporaneous in time, as indicated by the timing diagram of FIG. 5. This will occur during pump cycle A. Each pump cycle includes ten pulses and, as to be described in connection with the software shown in FIGS. 6 and 7, these pulses will only continue under predetermined conditions which are set by the software within the master and slave microcontrollers. Each IRQ or clock signal must be received at a slave microcontroller within a 400 msec. window which provides for the frequency check, one of the two checks for vitality. Within the slave microprocessor there is, assuming that the IRQ signal is received within the described window, a comparison between the data number from the master microcontroller with that also generated in the slave microcontroller and the shift registers for each of these two separated devices are the same and the numbers will be sequenced to be the same. Thus, there must be correspondence between the numbers before the circuit 14 can provide the described output.

The RC time constant circuit at the input of each FET provides a low pass filter to verify the functionality of the circuit 14. The first IRQ pulse in a series of such pulses to cause operation of the slave microcontroller will cause the slave microprocessor 20 to send a signal of an approximate 20 kHz frequency to the circuit 14. The signal will not be passed by the RC circuit forming the input filter for the FETS. Thus, there should be no output at VRO output 16. This is verified by the optoisolator feedback path 18 and is shown in that portion of the timing diagram of FIG. 5 as the "fast" cycle. After the fast cycle is over, the slave Microprocessor 20 will send a 1 kHz frequency signal to the FETS 14, and the signal of that frequency will be passed by the described RC circuits and this is characterized in the timing diagram of FIG. 5 as the normal cycle. Each cycle, both the fast and normal cycles, will last for a period of 10 msec., which is the time between successive IRQ pulses. The slave microprocessor will not provide any signal to the circuit 14 unless there is both frequency correspondence in that the IRQ signal is received within the predetermined window, as determined by the oscillator controlling the function of the slave microcontroller, and that there is correspondence of the two data bytes from the two independent shift registers or software equivalent which provide the pseudo-random numbers at the master and slave microcontrollers.

Figure 6:
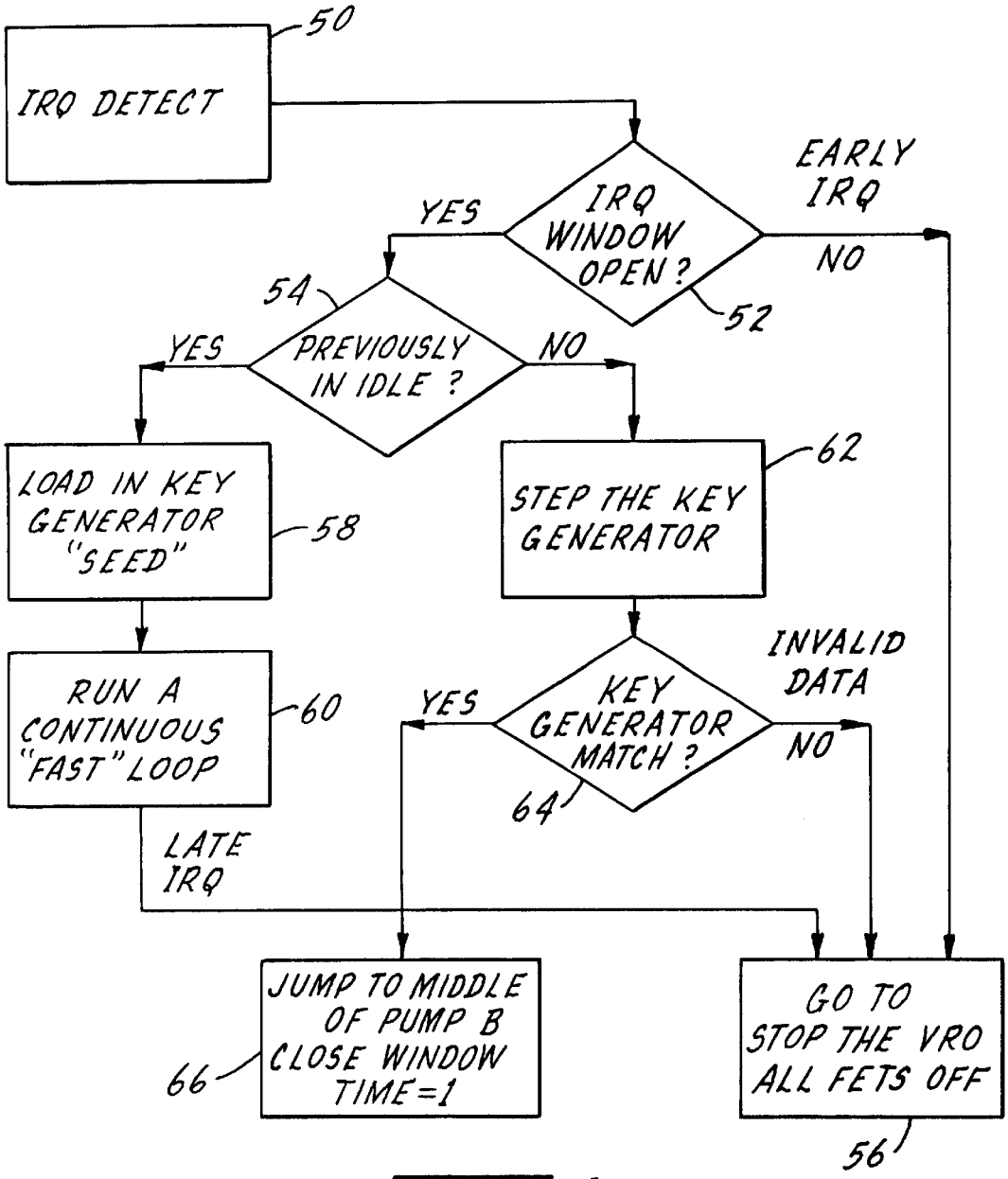
FIG. 6 is a software flow chart illustrating detection of a clock signal and subsequent functioning of the slave microcontroller.
Figure 7:
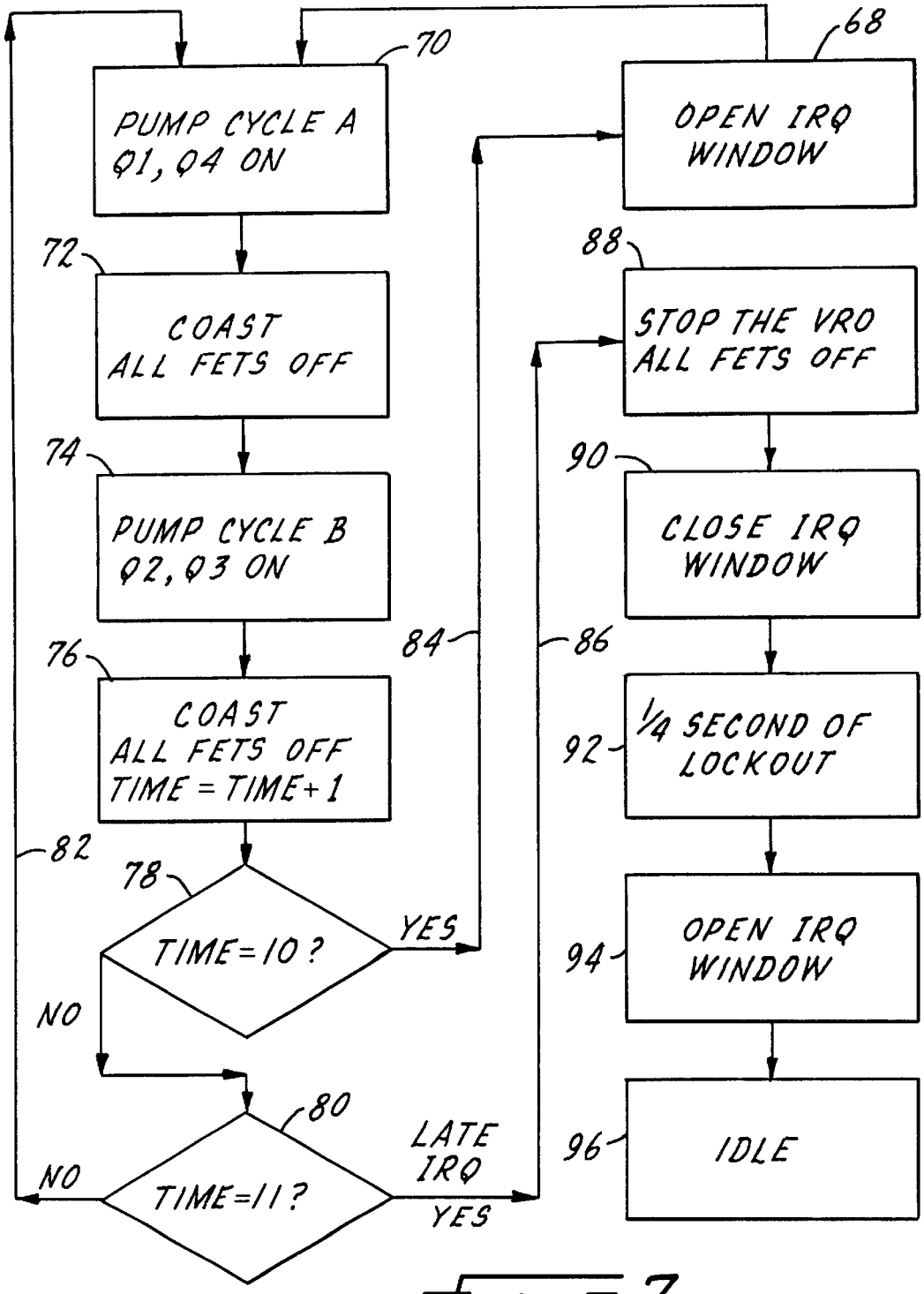
FIG. 7 is a software flow chart for the control of a slave microcontroller output.

FIGS. 6 and 7 are software flow charts illustrating the function of the software and hardware described herein. In FIG. 6 the IRQ clock is detected at stop 50 and if the IRQ window is open, as indicated by stop 52, a check will be made by stop 54 to determine if the circuit was previously in idle. Returning to stop 52, if the IRQ window is not open at a slave microcontroller, the IRQ being either early or late, a command indicating such is sent to stop 56 which has the effect of stopping the operation and no signal will be sent to the FETS. This shutdown or disable condition will remain for ¼sec.

Returning to stop 54, if the slave microcontroller had previously been in an idle condition, indicating either that it had been turned off or that no designated input had been received by the master microcontroller, then the key generator will be loaded with a particular number, that being the next number in sequence in the shift register. This is indicated by stop 58. This will send a command for a continuous fast loop run by stop 60 which is the fast cycle indicated in the timing diagram of FIG. 5. This high frequency signal will remain for a 10 msec. period and there should be no output fed back by the optoisolator 18 to the master microcontroller. If the next IRQ is late, indicating the fast loop continues, then stop 56 will stop the functioning of the slave microcontroller, again for a ¼ sec.

In the event that the previously in idle stop 54 provides a no response command, then the key generator controlling the number developed at the slave microprocessor, as indicated by stop 62, will be advanced to the next successive number. If there is a key generator match, as indicated by stop 64, then there will be an output from the slave microcontroller to the FET circuit 14 which will be introduced in the middle of pump cycle B at time=1, as indicated by stop 66. In the event the command from key generator match stop 64 is no, indicating invalid data, then the VRO output will be turned off, again for the ¼ sec. period.

FIG. 7 illustrates the function of circuit 14 during the period of operation after an IRQ signal has been detected during the period that the IRQ window is open. Stop 68 is indicative of an open IRQ window and it will start operation of pump cycle A, as shown by stop 70. The pulse for pump cycle A will be for a predetermined period, remembering that the pulses supplied by the FET circuits are non-overlapping and thus there is a coasting period indicated by stop 72 between a pulse of pump cycle A and a pulse of pump cycle B. After the coast period, pump cycle B will be on, as indicated by stop 74, and again there will be a coasting period after the pulse of pump cycle B, as indicated by stop 76. Stop 78 provides a counting function and will count the number of pulses provided by pump cycles A and B. If the number has not reached 10 in stop 78, then the software queries stop 80 to see if the time is actually equal to 11, or one more than the designated ten pulses. Assuming the answer is no, then there is a command for pump cycles A and B to repeat, as designated by command 82.

If the determination at stop 78 is that there have been ten pump cycles, then command 84 will go back to the IRQ window stop 68 to see if this window is open, and if it is, then the basic loop is repeated for the next 10 msec. Assuming that stop 80 indicates that ten pump cycles have been exceeded, or time=11, the IRQ to cause the cycle to repeat therefore must late and so command 86 is issued to stop the VRO and all FETS are then turned off, as indicated by stop 88. This commands the IRQ window to be closed, as indicated by stop 90.

When the IRQ window is closed, there is a ¼ sec. lockout, as indicated by stop 92, after which the IRQ window will be opened, as indicated by stop 94, which will place the hardware/software combination in an idle condition, as indicated by stop 96. Referring to FIG. 6, the next detected IRQ signal will repeat the cycle after the mandatory ¼ sec. lockout.

To summarize, the present invention insures vitality to signals that are designated for control of train movement, specifically such railroad devices as switches, wayside signals and crossing gates. There are independent frequency and pseudo-random number comparisons made to maintain a vital output from the VRO module. One number is generated at the master microcontroller and the second number is generated at each slave microcontroller. The method of generating the numbers, whether it be hardware or software, is the same and the sequence of numbers is the same. Although there may be independent frequency sources at both master and slave microcontrollers, they must be coordinated so that a clock signal sent from each master to a slave is received during a predetermined window of time. The data from the master to the slave may remain on line during the entire 10 msec. period, but correspondence is only required during the period of the clock window at the slave microprocessor. Assuming there is concurrence in both data and frequency, then non-overlapping square wave pulses are provided to a transformer, with the secondary square wave output being rectified to provide the nominal 12 volt output signal. The first of the ten cycles during the successive 10 msec. periods that the slave microprocessor will function, when commanded to do so, provides a frequency from the slave microprocessor to the FET circuit which is filtered out by the RC circuit providing the input for each FET. Thus, there should be no output signal from the VRO module and this is verified by the optoisolator feedback path which insures the functionality of each FET circuit. The successive or normal cycles following the first IRQ or clock of the series will provide a 1 kHz signal which is accepted by the filters provided by the RC circuits at the input of each FET.

The described cryptographic safe drive provides a vital output, only when a designated input is present at the master microcontroller. Vitality is insured by the statistical reliability of the data bytes and the frequency checks provided by the software and hardware circuits shown.

Whereas the preferred form of the invention has been shown and described herein, it should be realized that there may be many modifications, substitutions and alterations thereto.

The embodiments of the invention in which an exclusive property or privilege is claimed are defined as follows:

1. A method of controlling rail train movement through a railroad network including signals and switches in which the condition of a signal and the position of a switch is determined by vital output signals which are provided by a railroad signal output module, which module has a master microcontroller and a plurality of slave microcontrollers connected thereto, the master microcontroller including a pseudo-random number generator providing numbers in a predetermined sequence and a periodic clock signal, with the generator periodically changing the pseudo-random number in accordance with the time period of the clock signal, and wherein each slave microcontroller includes a pseudo-random number generator providing numbers in a predetermined sequence, which sequence is the same as that of the master microcontroller, the method including:

sending periodic clock signals from the master microcontroller to one of the slave microcontrollers;

sending a pseudo-random number from the master microcontroller to the one slave microcontroller at a time closely related to that of the clock signal;

comparing the pseudo-random number from the master microcontroller to the pseudo-random number from the one slave microcontroller, if said clock signal is received at the one slave microcontroller within a window period of time determined by the one slave microcontroller; and generating an output signal for use in controlling train movement at the one slave microcontroller if the pseudo-random numbers from the master microcontroller and the one slave microcontroller are identical.

2. A railroad vital signal output module which provides a predetermined output signal in response to a certain module input only under conditions that insure vitality of the output signal, said module including a master microcontroller and a plurality of slave microcontrollers connected thereto, said master microcontroller including means for generating pseudo-random numbers in a predetermined sequence and a periodic clock signal, said means for generating said pseudo-random numbers periodically changing the number in accordance with the time period of said clock signal, each slave microcontroller including means for generating pseudo-random numbers in a predetermined sequence, which sequence is the same as that of the master microcontroller, each slave microcontroller being connected to said master microcontroller to receive the master clock signal and the master pseudo-random number, each slave microcontroller being programmed to accept a master clock signal only during a predetermined time window and being programmed to compare the master pseudo-random number with the slave pseudo-random number only if the clock signal is received at the slave microcontroller during the predetermined time window, each slave microcontroller including circuit means for providing said predetermined output signal in response to identity between said master pseudo-random number and a slave pseudo-random number as determined by comparison at said slave microcontroller.

3. The railroad vital signal output module of claim 2 including a feedback path connecting each slave microcontroller circuit means output to the master microcontroller to verify functionality of the slave microcontroller circuit means.

4. The railroad vital signal output module of claim 3 wherein the master microcontroller is programmed to delay its clock signal to a slave microcontroller upon indication that a slave microcontroller circuit means is non-functional.

5. The railroad vital signal output module of claim 4 wherein said feedback path includes an optoisolator.

6. The railroad vital signal output module of claim 4 wherein each slave microcontroller circuit means includes a filter, each slave microcontroller being programmed to provide signals of a first frequency and of a second frequency to its circuit means, with said filter only being responsive to signals of one of said frequencies, said circuit means providing said predetermined output signal in response to a signal of only one of said first and second frequency signals.

7. The railroad vital signal output module of claim 2 wherein the master microcontroller is programmed to temporarily disable a slave microcontroller upon determination that its circuit means is not functioning to provide the predetermined output signal.

8. The railroad vital signal output module of claim 2 wherein each slave microcontroller only provides a predetermined output signal during the period between successive clock signals and only if there is identity between the pseudo-random numbers generated by the master microcontroller and by the slave microcontroller.

9. The railroad vital signal output module of claim 2 wherein each slave microcontroller circuit means includes a plurality of solid state devices and a transformer having a primary and a secondary, said solid state devices being connected to the slave microcontroller to provide a series of square wave pulses to said transformer primary, the secondary of said transformer providing the predetermined output signal.

10. The railroad vital signal output module of claim 9 wherein said solid state devices include a plurality of field effect transistors arranged to alternately provide square wave pulses to the transformer primary.

11. The railroad vital signal output module of claim 10 including a rectifier circuit connected to said transformer secondary.

12. The railroad vital signal output module of claim 10 further including a filter connected between an input of each field effect transistor and the slave microcontroller to frequency limit the signals which will activate each of said field effect transistors.

13. The railroad vital signal output module of claim 12 wherein each of said said filters includes an RC circuit.

14. A method of insuring vitality to the output signal of a railroad signal output module having a master microcontroller and a plurality of slave microcontrollers connected thereto, said master microcontroller including means for generating pseudo-random numbers in a predetermined sequence and a periodic clock signal and means for periodically changing the pseudo-random number in accordance with the time period of said clock signal, and wherein each slave microcontroller includes means for generating pseudo-random numbers in a predetermined sequence, which sequence is the same as that of the master microcontroller, said method including the steps of:

sending periodic clock signals from said master microcontroller to one of said slave microcontrollers;

sending a pseudo-random number from said master microcontroller to said one slave microcontroller at a time closely related to that of said clock signal;

comparing the pseudo-random number from said master microcontroller to the pseudo-random number from said one slave microcontroller if said clock signal is received at said one slave microcontroller within a window period of time determined by said one slave microcontroller; and generating an output signal at said one slave microcontroller if the pseudo-random numbers from said master microcontroller and the said one slave microcontroller are identical.

15. The method of claim 14 including the further step of establishing a feedback path from the output of said one slave microcontroller to said master controller to verify the functionality of said one slave microcontroller.

16. The method of claim 15 including the step of delaying transmission of a clock signal from the master microcontroller to said one slave microcontroller upon indication through the feedback path that the slave microcontroller is non-functional.

17. The method of claim 15 wherein non-functionality of said one slave microcontroller is determined by sampling the output thereof during a time period of an internally generated signal in said one slave microcontroller, which internally generated signal should not provide an output from said one slave microcontroller.

18. The method of claim 17 in which said one slave microcontroller generates an internal signal of a first frequency and an internal signal of a second frequency, with only one of said two different frequency signals providing a valid output signal from said one slave microcontroller.

19. A railroad vital signal output module which provides a predetermined output signal in response to a certain module input only under conditions that insure vitality of the output signal, said module including a master microcontroller and a plurality of slave microcontrollers connected thereto, said master microcontroller including a clock signal generator, a pseudo-random number generator providing numbers in a predetermined sequence, which pseudo-random numbers periodically change in accordance with the time period of said clock signal, each slave microcontroller including a pseudo-random number generator providing numbers in a predetermined sequence, which sequence is the same as that of the master microcontroller, each slave microcontroller being connected to said master microcontroller to receive the master clock signal and the master pseudo-random number, each slave microcontroller being programmed to accept a master clock signal only during a predetermined time window and being programmed to compare the master pseudo-random number with the slave pseudo-random number only if the clock signal is received at the slave microcontroller during the predetermined time window, each slave microcontroller including an output circuit for providing said predetermined output signal in response to identity between said master pseudo-random number and a slave pseudo-random number as determined by comparison at said slave microcontroller.

20. A method of insuring vitality to the output signal of a railroad signal output module having a master microcontroller and a plurality of slave microcontrollers connected thereto, said master microcontroller including a pseudo-random number generator providing numbers in a predetermined sequence and a periodic clock signal, with the generator periodically changing the pseudo-random number in accordance with the time period of the clock signal, and wherein each slave microcontroller includes a pseudo-random number generator providing numbers in a predetermined sequence, which sequence is the same as that of the master microcontroller, said method includes:

sending periodic clock signals from said master microcontroller to one of said salve microcontrollers;

sending a pseudo-random number from said master microcontroller to said one slave microcontroller at a time closely related to that of said clock signal;

comparing the pseudo-random number from said master microcontroller to the pseudo-random number from said one slave microcontroller if said clock signal is received at said one slave microcontroller within a window period of time determined by said one slave microcontroller; and generating an output signal at said one slave microcontroller if the pseudo-random numbers from said master microcontroller and the said one slave microcontroller are identical.

* * * * *